US010059117B2

(12) United States Patent
Ito et al.

(10) Patent No.: US 10,059,117 B2
(45) Date of Patent: Aug. 28, 2018

(54) LIQUID EJECTING APPARATUS AND LIQUID SUPPLY METHOD OF LIQUID EJECTING APPARATUS

(71) Applicant: SEIKO EPSON CORPORATION, Tokyo (JP)

(72) Inventors: Hiroyuki Ito, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/660,740

(22) Filed: Jul. 26, 2017

(65) Prior Publication Data

US 2018/0043698 A1 Feb. 15, 2018

(30) Foreign Application Priority Data

Aug. 12, 2016 (JP) ..... 2016-158437

(51) Int. Cl.
*B41J 2/175* (2006.01)

(52) U.S. Cl.
CPC ..... *B41J 2/17596* (2013.01); *B41J 2/17503* (2013.01)

(58) Field of Classification Search
CPC ..... B41J 2/17596; B41J 2/17503
USPC ..... 347/6
See application file for complete search history.

(56) References Cited

U.S. PATENT DOCUMENTS 6,281,916 B1 * 8/2001 VanSteenkiste ..... B41J 2/175 347/85
9,073,336 B1 7/2015 Matsumoto et al.
2005/0104942 A1 * 5/2005 Katayama ..... B41J 2/17523 347/86
2006/0203045 A1 9/2006 Kobayashi et al.
2009/0147053 A1 6/2009 Yokouchi
2010/0020137 A1 * 1/2010 Yokouchi ..... B41J 2/175 347/85

(Continued)

FOREIGN PATENT DOCUMENTS

JP 10-193639 A 7/1998
JP 2000-158663 A 6/2000

(Continued)

OTHER PUBLICATIONS

European Search Report issued in EP 17185847 dated Jan. 15, 2018.

*Primary Examiner* — Huan Tran
*Assistant Examiner* — Alexander D Shenderov
(74) *Attorney, Agent, or Firm* — Workman Nydegger

(57) ABSTRACT

There is provided a liquid ejecting apparatus including a liquid ejecting portion that has a nozzle and performs a recording process by ejecting liquid from the nozzle toward a medium, a supply flow path that is provided so as to allow the liquid that is accommodated in a liquid accommodating body to flow toward the liquid ejecting portion, and a pressure feeding mechanism that forcefully causes the liquid to flow from the liquid accommodating body toward the liquid ejecting portion, and an accommodating body holding portion that is capable of having the liquid accommodating body mounted thereon and is disposed at a supply position at which it is possible to supply the liquid to the liquid ejecting portion using a water head with respect to the nozzle of the liquid that is accommodated in the mounted liquid accommodating body.

13 Claims, 6 Drawing Sheets

(56) References Cited

U.S. PATENT DOCUMENTS

| | | | | |
|---|---|---|---|---|
| 2010/0053258 | A1* | 3/2010 | Seino | B41J 2/1652 347/30 |
| 2010/0245411 | A1 | 9/2010 | Kato et al. | |
| 2011/0317204 | A1 | 12/2011 | Tanner et al. | |
| 2014/0253645 | A1 | 9/2014 | Tsukahara et al. | |
| 2015/0077462 | A1 | 3/2015 | Suzuki | |
| 2016/0089895 | A1 | 3/2016 | Iwase et al. | |

FOREIGN PATENT DOCUMENTS

| | | | |
|---|---|---|---|
| JP | 2001-030509 | A | 2/2001 |
| JP | 2002-178498 | A | 6/2002 |
| JP | 2006-021398 | A | 1/2006 |
| JP | 2006-168341 | A | 6/2006 |
| JP | 2006-212846 | A | 8/2006 |
| JP | 2007-160849 | A | 6/2007 |
| JP | 2007-290388 | A | 11/2007 |
| JP | 2009-160912 | A | 7/2009 |
| JP | 2009-202347 | A | 9/2009 |
| JP | 2009-226625 | A | 10/2009 |
| JP | 2010-228358 | A | 10/2010 |
| JP | 2012-030496 | A | 2/2012 |
| JP | 2012-166509 | A | 9/2012 |
| JP | 2014-162006 | A | 9/2014 |
| JP | 2014-188924 | A | 10/2014 |
| JP | 2015-054498 | A | 3/2015 |
| JP | 2015-080862 | A | 4/2015 |
| JP | 2015-107660 | A | 6/2015 |
| JP | 2015-112800 | A | 6/2015 |
| JP | 2016-022626 | A | 2/2016 |
| JP | 2016-068341 | A | 5/2016 |

* cited by examiner

LIQUID EJECTING APPARATUS AND LIQUID SUPPLY METHOD OF LIQUID EJECTING APPARATUS

BACKGROUND

1. Technical Field

The present invention relates to a liquid ejecting apparatus such as a printer.

2. Related Art

In the related art, there is a liquid ejecting apparatus that drives a diaphragm pump which is provided on a supply flow path and supplies liquid to a liquid ejecting head that ejects the liquid (for example, JP-A-2009-160912).

In the liquid ejecting apparatus described above, it is necessary to frequently drive a pump such that the internal pressure of the supply flow path is maintained at a necessary pressure to supply liquid without deficiency. There is a problem in that when the driving time of the pump becomes long, the life of the pump is shortened.

SUMMARY

An advantage of some aspects of the invention is that a liquid ejecting apparatus is provided in which the driving time of a pressure feeding mechanism that pressure feeds liquid can be shortened, and a liquid ejecting apparatus which is able to perform stable ejection of a liquid is provided.

According to an aspect of the invention, there is provided a liquid ejecting apparatus including a liquid ejecting portion that has a nozzle and performs a recording process by ejecting liquid from the nozzle toward a medium, a supply flow path that is provided so as to allow the liquid that is accommodated in a liquid accommodating body to flow toward the liquid ejecting portion, a pressure feeding mechanism that forcefully causes the liquid to flow from the liquid accommodating body toward the liquid ejecting portion, and an accommodating body holding portion that is capable of having the liquid accommodating body mounted thereon and is disposed at a supply position at which it is possible to supply the liquid to the liquid ejecting portion using a water head with respect to the nozzle of the liquid that is accommodated in the mounted liquid accommodating body.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of a liquid ejecting apparatus will be described below with reference to the drawings. For example, the liquid ejecting apparatus is an ink jet printer that performs recording (printing) by ejecting ink, which is an example of liquid, on a medium such as a paper sheet.

Figure 1:
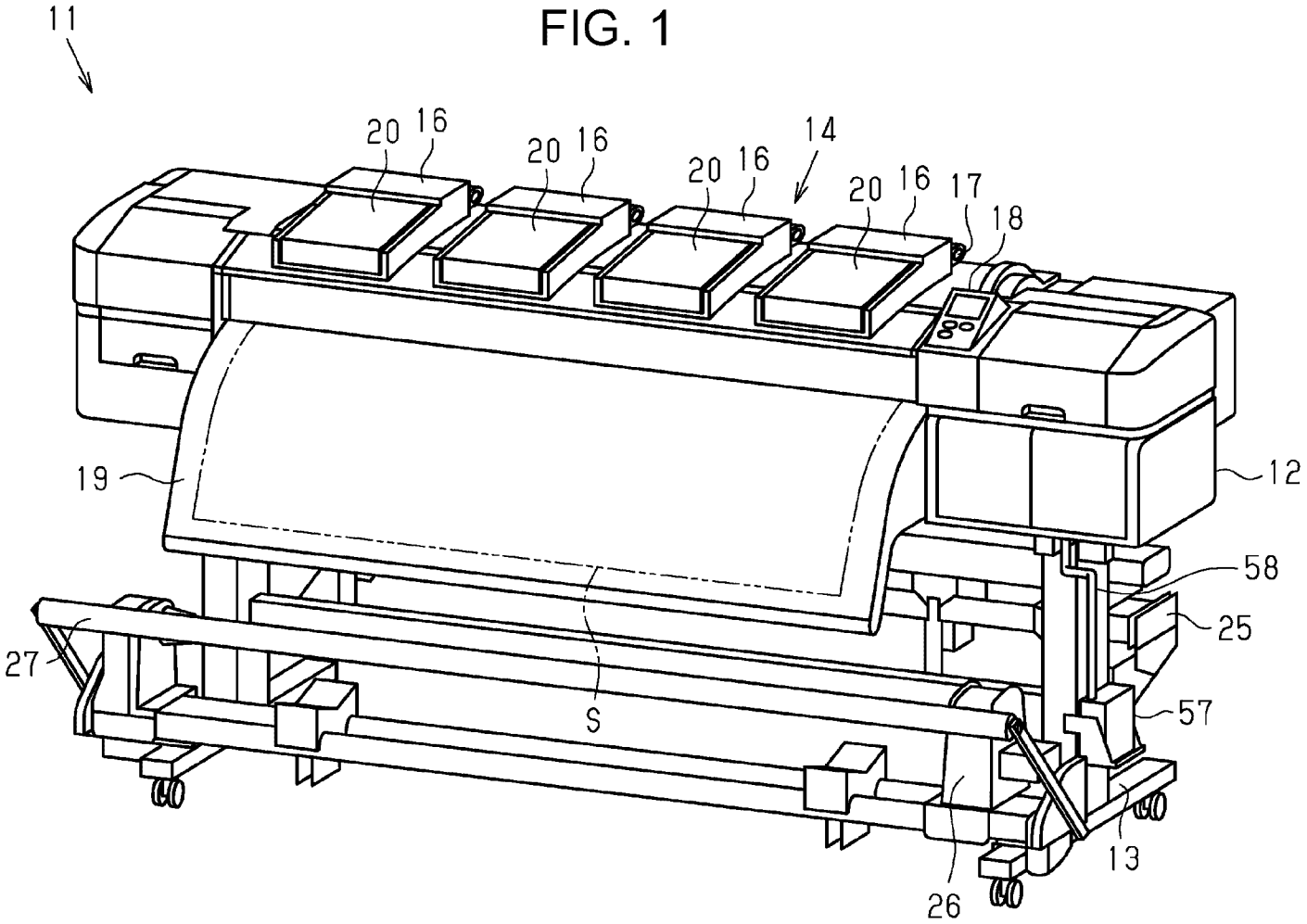
FIG. 1 is a perspective view illustrating an embodiment of a liquid ejecting apparatus.

As shown in FIG. 1, a liquid ejecting apparatus 11 of the present embodiment is a large format printer (LFP) that performs printing on a medium S of a comparatively large size, for example, JIS standards A0 size, B0 size, or the like.

The liquid ejecting apparatus 11 is provided with a casing 12, a support leg portion 13 that supports the casing 12, and a liquid supply device 14 that is disposed on the casing 12. The liquid supply device 14 is provided with one or a plurality (four in the embodiment) of accommodating body holding portions 16 that are each capable of having a liquid accommodating body 20 that accommodates liquid mounted thereon, and a rotary shaft 17 that is provided on the base end side of the accommodating body holding portion 16. The accommodating body holding portion 16 holds the liquid accommodating body 20 that is mounted thereon.

Assuming that a side at which the printed medium S comes out of the casing 12 is a front side, an operation portion 18 that performs an operation of the liquid ejecting apparatus 11 is provided on the front side of the casing 12. In addition, a support protruding portion 19 that is guided downward while supporting the printed medium S protrudes from a front surface part of the casing 12.

Figure 2:
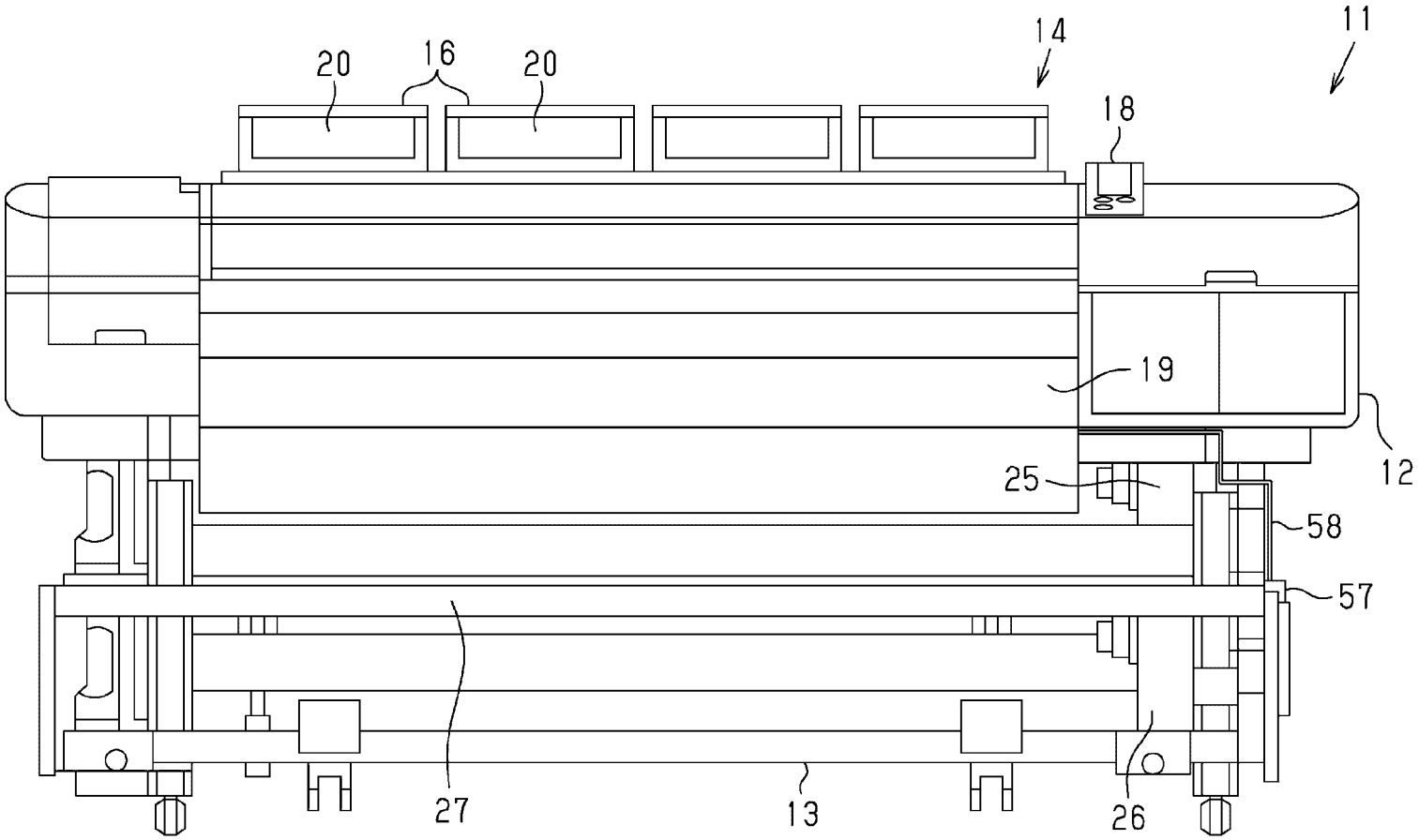
FIG. 2 is a front surface view of the liquid ejecting apparatus in FIG. 1.

As shown in FIG. 2, the casing 12 is divided into a center part in which a transport path of the medium S is disposed, such as the support protruding portion 19, and two end parts which are outside the transport path in the longitudinal direction (left and right direction in FIG. 2). Preferably the liquid supply device 14 is disposed in the center part in the longitudinal direction in which the transport path of the medium S is disposed.

A plurality of accommodating body holding portions 16 may be disposed lined up in the longitudinal direction of the casing 12 in a case where there are a plurality of accommodating body holding portions 16. The liquid accommodating body 20 is attached to and detached from the accommodating body holding portion 16 when the accommodating body holding portion 16 is at an attachment and detachment position that is indicated in FIG. 2. Therefore, preferably the accommodating body holding portion 16 has a flat posture in which the width and the depth becomes longer than the height of the liquid accommodating body 20 at the attachment and detachment position. When such a flat posture is set, it is possible to stably perform an attachment and detachment operation while limiting the height even if the liquid accommodating body 20 is large. In addition, the own weight of the liquid accommodating body 20 tends not to influence the attachment and detachment operation when attachment to and detachment from the accommodating body holding portion 16 is performed by horizontal movement of the liquid accommodating body 20.

Figure 3:
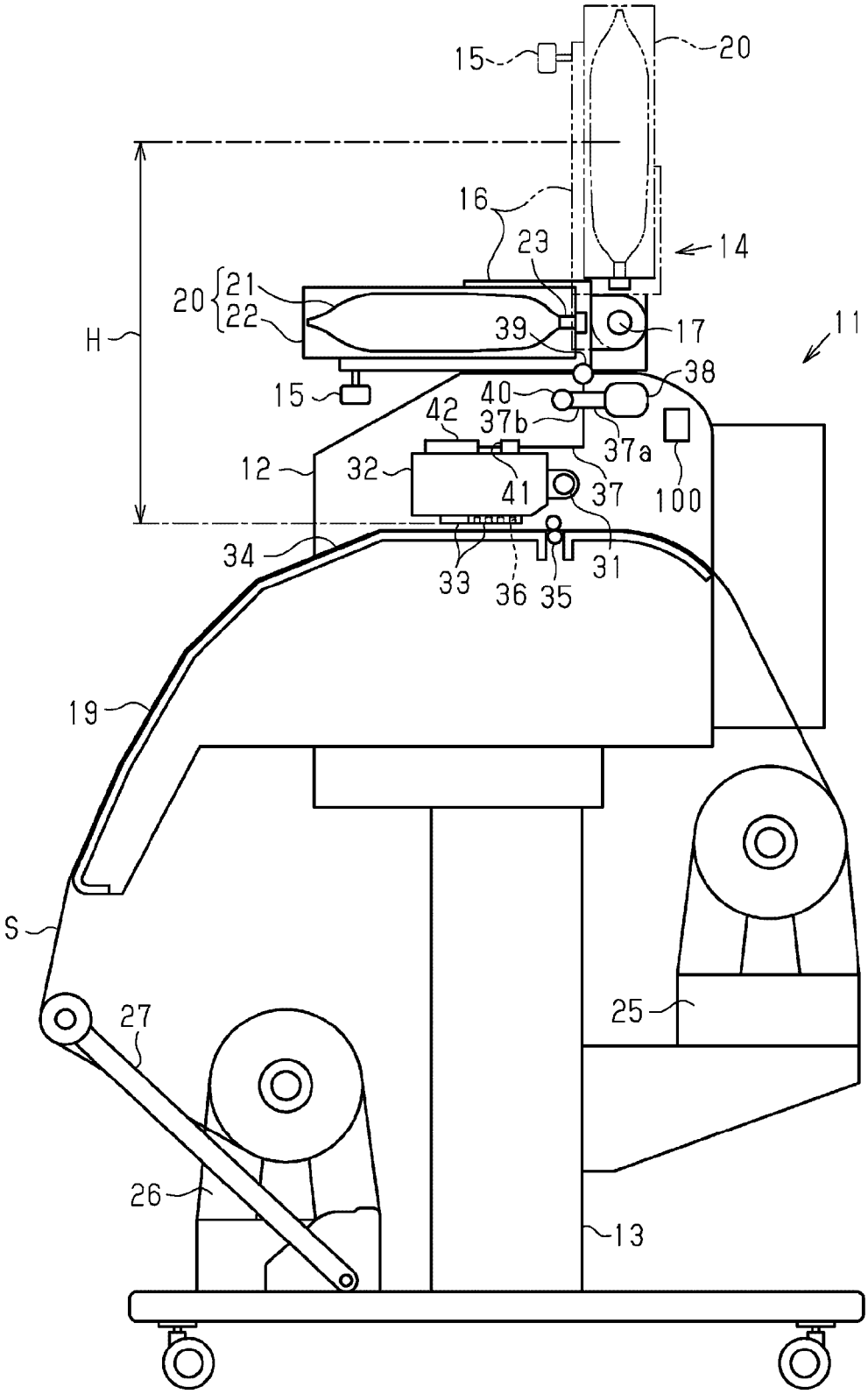
FIG. 3 is a schematic diagram illustrating the entire configuration of the liquid ejecting apparatus in FIG. 1.

As shown in FIG. 3, the liquid ejecting apparatus 11 may be provided with a feeding mechanism 25 that holds, to be rotatable, the previously used medium S that is wound in a cylindrical shape (for example, a paper roll), a winding mechanism 26 that winds the printed medium S that comes out from the casing 12, and a tension bar 27 that applies tension to the medium S that comes out from the casing 12. According to this configuration, it is possible to continuously perform a recording process on a long medium S that is wound in the cylindrical shape.

A guide shaft 31 that extends in the longitudinal direction, a carriage 32 that reciprocally moves along the guide shaft 31, one or a plurality (two in the embodiment) of liquid ejecting portions 33 that are held in the carriage 32 (refer to FIG. 4), a support portion 34 that forms the transport path of the medium S within the casing 12, and a transport mechanism 35 that transports the medium S within the casing 12 are accommodated within the casing 12.

The liquid ejecting portion 33 has a plurality of nozzles 36, and performs the recording process by ejecting the liquid from a nozzle 36 toward the medium S that is transported on the support portion 34 by the transport mechanism 35. In the embodiment, the movement direction of the carriage 32 and the longitudinal direction of the casing 12 match. In addition, the transport path of the medium S on the support portion 34 intersects with (preferably is orthogonal to) the movement direction of the carriage 32.

The supply flow path 37 that causes the liquid that is accommodated in the liquid accommodating body 20 to flow toward the liquid ejecting portion 33 is connected to the carriage 32. The accommodating body holding portion 16 is disposed at a position to which it is possible to supply the liquid to the liquid ejecting portion 33 using a water head that is generated due to a difference in height between the liquid that is accommodated in the mounted liquid accommodating body 20 and the nozzle 36. Note that, "water head" refers to liquid pressure in terms of the height of a liquid column in the direction of gravity, and has a length dimension (for example, m). For example, when the liquid is water, a water head of 1 m converts to a pressure is 9.8 kPa.

The accommodating body holding portion 16 is provided to be movable between the attachment and detachment position that is indicated by a solid line in FIG. 3 and the supply position that is indicated by a two-dot chain line in FIG. 3. In the embodiment, the accommodating body holding portion 16 moves between the supply position and the attachment and detachment position by rotating approximately 90 degrees about the rotary shaft 17. In a case where there are a plurality of accommodating body holding portions 16, the plurality of accommodating body holding portions 16 may be configured to individually rotate, or may be configured to collectively rotate.

It is also possible to configure the accommodating body holding portion 16 so as to rotate due to the driving force of a driving source which is not shown in the drawings centered on the rotary shaft 17 and it is also possible to configure so as to manually rotate. For example, the driving source for rotating the accommodating body holding portion 16 may be shared with a motor that is provided for unwinding an unused medium S that is wound in a cylindrical shape and winding the printed medium S. In a case where the accommodating body holding portion 16 is manually rotated, a handle 15 may be provided in the accommodating body holding portion 16.

Note that, the rotation angle may be smaller than 90 degrees and the posture of the liquid accommodating body 20 that is diagonal with respect to the horizontal plane may be set at the attachment and detachment position or the supply position of the accommodating body holding portion 16. In either case, preferably the value of pressure equivalent to the water head that is generated by a difference in height between the liquid that is accommodated in the liquid accommodating body 20 at the supply position and the nozzle 36 is larger than the pressure loss that is generated when the liquid is ejected for a recording process.

Preferably the liquid accommodating body 20 that is mounted in the accommodating body holding portion 16 at the supply position is in a vertical posture in which the height is longer than when at the attachment and detachment position. In addition, preferably the position of the mounted liquid accommodating body 20 is lower at the attachment and detachment position than at the supply position.

For example, the liquid accommodating body 20 may be a cartridge that has a liquid accommodating portion 21 that consists of a bag that has flexibility and a case 22 that accommodates the liquid accommodating portion 21, and may be a tank that directly accommodates the liquid. In addition, the liquid accommodating portion 21 that consists of a bag having flexibility may be set in a tray that is attachable to and detachable from the accommodating body holding portion 16 as the liquid accommodating body 20, and may be formed so as to be mounted in the accommodating body holding portion 16 along with the tray. When the liquid accommodating portion 21 has a lead-out portion 23 that is an outlet for the accommodated liquid and is mounted on the accommodating body holding portion 16, the liquid accommodating portion 21 is connected to the upstream end of the supply flow path 37 so as to be in a state in which it is possible to supply the liquid through the lead-out portion 23. By arranging the lead-out portion 23 so as to be disposed below the liquid accommodating portion 21 at the supply position, the liquid tends to flow out from the liquid accommodating portion 21 due to the water head.

The liquid ejecting apparatus 11 is provided with a pressure feeding mechanism 38 that forcefully causes the liquid to flow from the liquid accommodating body 20 toward the liquid ejecting portion 33, and a control portion 100 that performs control of various mechanisms that the liquid ejecting apparatus 11 is provided with. The pressure that the pressure feeding mechanism 38 is able to apply to the liquid is preferably larger than the value of pressure equivalent to the water head at the supply position. The control portion 100 switches between supply of the liquid by the water head and supply of the liquid by the pressure feeding mechanism 38 by performing drive control of the pressure feeding mechanism 38 at a designated timing.

In the liquid accommodating body 20, in a case where the liquid is accommodated (filled) in the liquid accommodating portion 21 that consists of a closed bag, a "water head center" is present in the accommodated liquid. The "water head center" is equivalent to a liquid surface of the accommodated liquid in a so-called open system liquid accommodating portion that is open to the atmosphere by an internal space. Then, the water head (energy at the position of the liquid), with respect to the nozzle 36, which is generated by the liquid accommodated in the liquid accommodating portion 21 that is disposed at the supply position is defined by a difference in height between the "water head center" and the nozzle 36.

The "water head center" is moved down in the direction of gravity when the remaining amount of the liquid that is accommodated in the liquid accommodating portion 21 becomes small in the same manner as the liquid surface of the liquid that is accommodated in the open system liquid accommodating portion. The liquid is filled into the liquid accommodating portion 21 in the unused state in the embodiment such that the "water head center" is approximately half of the height of the liquid accommodating portion 21 that is disposed at the supply position, and the maximum value of the water head is equivalent to the difference in height H in FIG. 3.

At the upstream side, the supply flow path 37 may branch into two branched flow paths 37*a* and 37*b* connected to the accommodating body holding portion 16. In this case, the pressure feeding mechanism 38 may be provided in one branched flow path 37*a*, and a one-way valve 40 that suppresses flow of the liquid upstream while permitting flow of the liquid downstream may be provided in the other branched flow path 37*b*.

An opening/closing valve 39 is provided further upstream than the branched flow paths 37*a* and 37*b* on the supply flow path 37. The opening/closing valve 39 permits flow of the liquid when in an open valve state and regulates the flow of the liquid when in a closed valve state. Preferably, the opening/closing valve 39 is configured to be switchable between the open valve state and the closed valve state by performing opening/closing control of the control portion 100.

Figure 4:
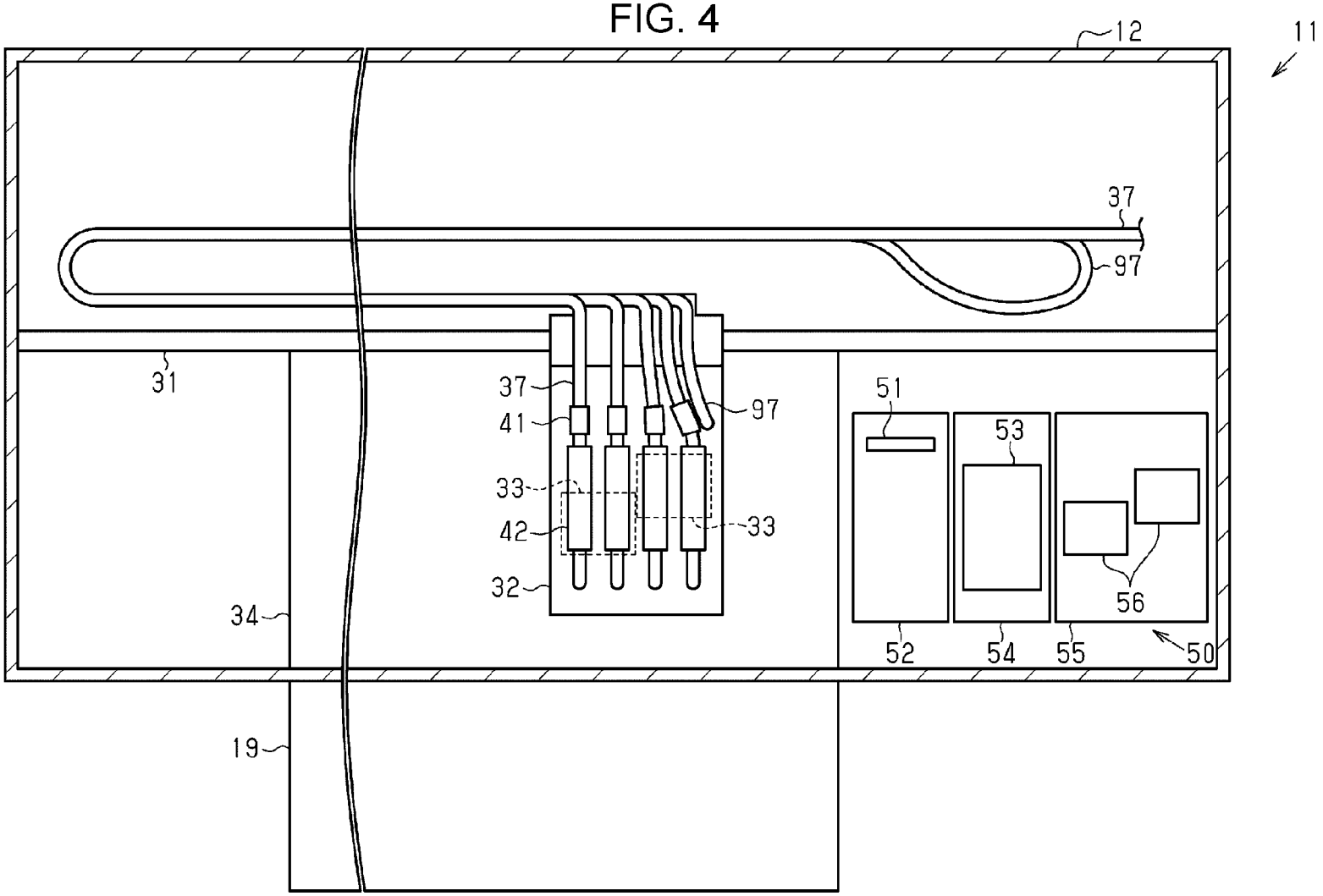
FIG. 4 is a schematic diagram illustrating a planar configuration within a casing in which the liquid ejecting apparatus in FIG. 1 is provided.

As shown in FIG. 4, the supply flow path 37 is drawn around such that an extension direction in the longitudinal direction is reversed inside the casing 12, and the downstream side of the supply flow path 37 is connected to the carriage 32.

Preferably, a filter unit 41 that captures foreign matter such as air bubbles that are mixed in the liquid is provided on the supply flow path 37. It is possible to easily perform maintenance such as replacement when the filter unit 41 is exposed to the outside the carriage 32. It is possible to reduce polarization of concentration in the liquid when a static mixer 42 (refer to FIG. 5) in which a change such as change in direction or division of the flow of the liquid is provided on the supply flow path 37, for example, on the downstream side of the filter unit 41.

When the right end side in FIG. 4 is set as the starting end of outward movement of the carriage 32, a maintenance mechanism 50 that is provided to perform maintenance on the liquid ejecting portion 33 is disposed in the right side part inside the casing 12 outside the transport path. The maintenance mechanism 50 is provided with a wiping device 52 that has a wiping member 51 which wipes the liquid ejecting portion 33, a flushing unit 54 that has a liquid accommodating portion 53 that accommodates the liquid that is ejected by the liquid ejecting portion 33, and a cleaning mechanism 55 that performs cleaning on the liquid ejecting portion 33. The wiping device 52, the flushing unit 54, and the cleaning mechanism 55 are disposed in line in the longitudinal direction and are disposed next to the support portion 34.

The wiping device 52 performs wiping of the liquid ejecting portion 33 by moving the wiping member 51 relative to the liquid ejecting portion 33. The flushing unit 54 has the object of preventing or eliminating clogging of the nozzle 36, and accommodates flushed liquid using the liquid accommodating portion 53 when performing flushing of liquid droplets from the nozzle 36. For example, it is possible to configure the liquid accommodating portion 53 using a rotating endless belt.

Figure 5:
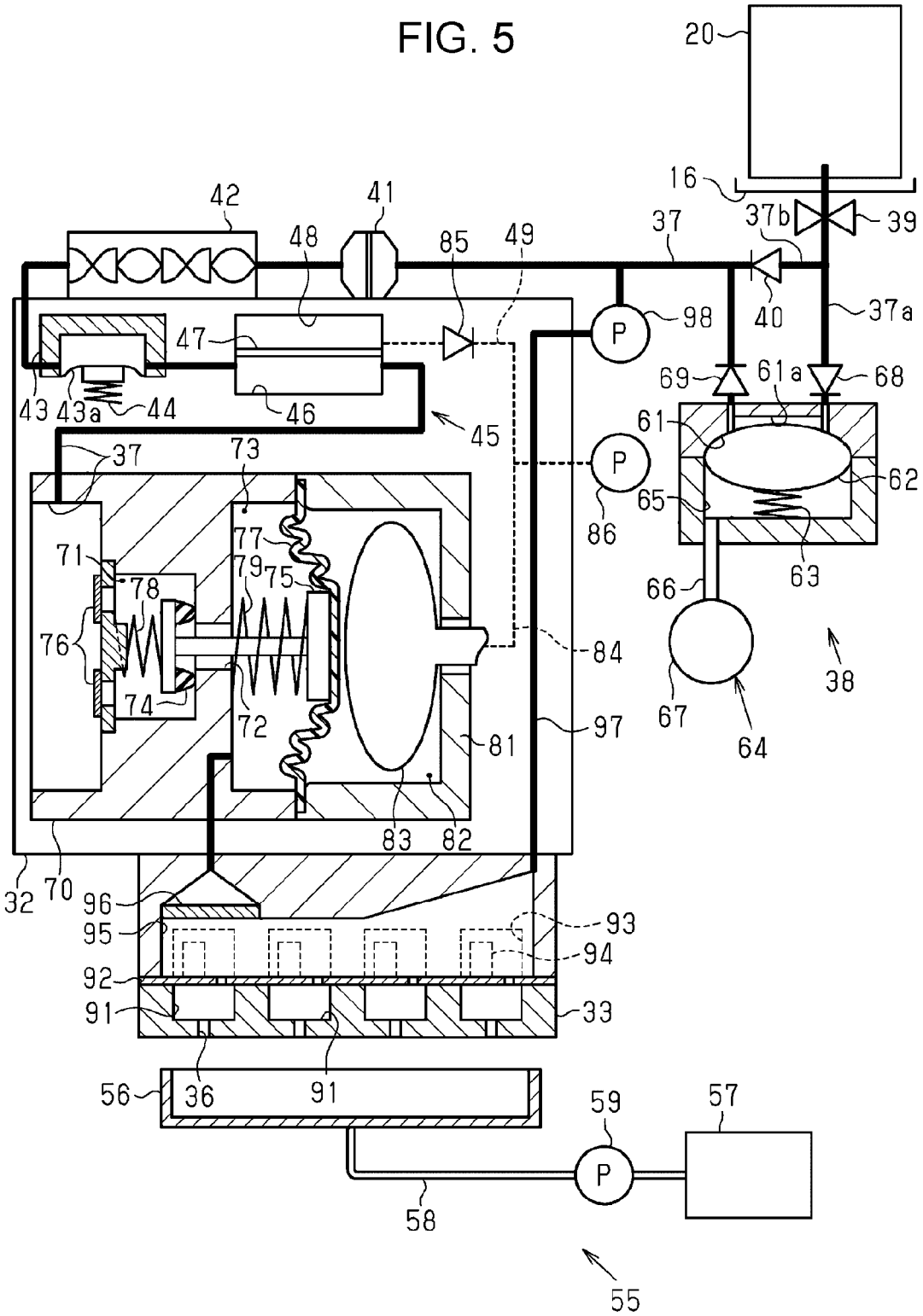
FIG. 5 is a schematic diagram illustrating a flow path configuration of the liquid ejecting apparatus in FIG. 1.

As shown in FIG. 5, the cleaning mechanism 55 is provided with a cap 56 that forms a closed space that opens to the nozzle 36 with the liquid ejecting portion 33, a waste liquid accommodating body 57 that accommodates waste liquid, a suction flow path 58 that connects the cap 56 and the waste liquid accommodating body 57, and a suction pump 59 that is provided on the suction flow path 58. The waste liquid accommodating body 57 may be disposed outside the casing 12 (refer to FIG. 1).

The cleaning mechanism 55 performs suction cleaning in which the liquid is discharged from the nozzle 36 by generating negative pressure in the closed space by driving the suction pump 59 in a state in which the cap 56 forms the closed space. Foreign matter such as air bubbles in the liquid ejecting portion 33 and the like is discharged along with liquid by suction cleaning. The liquid that is discharged from the nozzle 36 passes through the suction flow path 58 as waste liquid and is accommodated in the waste liquid accommodating body 57.

A liquid retaining portion 43, a deaerating mechanism 45, and a pressure adjustment mechanism 70 may be provided on the supply flow path 37 that is connected to the carriage 32. On the supply flow path 37, the liquid retaining portion 43 that is provided between the opening/closing valve 39 and the pressure adjustment mechanism 70 is constituted by a flexible member 43*a* in which a part of a wall surface can be flexibly displaced, and forms a variable capacity space. The liquid retaining portion 43 retains the liquid in the variable capacity space that is placed under pressure due to a biasing force of a spring 44, and mitigates variation of pressure of the liquid.

The deaerating mechanism 45 is provided with a deaerating chamber 46 that temporarily retains the liquid, a decompression chamber 48 that is partitioned into the deaerating chamber 46 and a deaerating film 47, a decompression flow path 49 that connects the decompression chamber 48, and a pump 86. The deaerating film 47 has a property of allowing air to pass through but not allowing the liquid to pass through, and removes air bubbles and dissolved gas that are mixed in the liquid that is retained in the deaerating chamber 46 by reducing pressure in the decompression chamber 48 through the decompression flow path 49 by driving of the pump 86.

The pressure adjustment mechanism 70 is provided with a supply chamber 71 that is provided on the supply flow path 37, a pressure chamber 73 that is linkable via the supply chamber 71 and a linking hole 72, a valve body 74 that is able to open and close the linking hole 72, and a pressure receiving member 75 in which a base end side is accommodated in the supply chamber 71 and a tip end side is accommodated in the pressure chamber 73. For example, the valve body 74 consists of an elastic body that is attached to a base end part of the pressure receiving member 75 that is positioned inside the supply chamber 71. A filter 76 through which the liquid that flows into the supply chamber 71 is filtered may be provided on the supply flow path 37.

A part of the wall surface of the pressure chamber 73 is formed of a flexible film 77 that can be flexibly displaced. In addition, the pressure adjustment mechanism 70 is provided with a first biasing member 78 that is accommodated in the supply chamber 71, and a second biasing member 79 that is accommodated in the pressure chamber 73. The first biasing member 78, via the pressure receiving member 75, biases the valve body 74 in a direction that causes the linking hole 72 to be closed.

The pressure receiving member 75 is displaced by flexibly displacing and pressing in a direction in which the flexible film 77 reduces the capacity of the pressure chamber 73. In the valve body 74, pressure (internal pressure) that is applied to the inside surface that is the pressure chamber 73 side of the flexible film 77 is lower than pressure (external pressure) that is applied to the outside surface that is the opposite side from the pressure chamber 73 of the flexible film 77, and the valve body 74 switches from the closed valve state to the open valve state when the difference between the pressure that is applied to the inside surface and the pressure that is applied to the outside surface is a designated value (for example, 1 kPa) or more.

Note that, the designated value is a value that is determined in accordance with the biasing force of the first biasing member 78 and the second biasing member 79, necessary force for displacing the flexible film 77, necessary pressing force (sealing load) for closing the linking hole 72 using the valve body 74, pressure within the supply chamber 71 and pressure within the pressure chamber 73 that act on the supply chamber 71 side of the pressure receiving member 75 and the front surface of the valve body 74.

That is, the larger the biasing force of the first biasing member 78 and the second biasing member 79, the larger the designated value. In addition, the biasing force of the first biasing member 78 and the second biasing member 79 is set such that the pressure within the pressure chamber 73 is in a negative pressure state in a range in which it is possible to form a meniscus on the gas-liquid interface in the nozzle 36 (−1 kPa in a case where, for example, pressure that is applied to the outside surface of the flexible film 77 is atmospheric pressure).

When the linking hole 72 is open and the liquid flows into the pressure chamber 73 from the supply chamber 71, internal pressure of the pressure chamber 73 rises. Then, when the internal pressure of the pressure chamber 73 is the designated value described above, the valve body 74 closes the linking hole 72.

The internal pressure of the pressure chamber 73 lowers accompanying discharge of the liquid from the liquid ejecting portion 33. Then, the valve body 74 autonomously opens and closes the linking hole 72 according to the difference of pressure of external pressure (atmospheric pressure) of the pressure chamber 73 and internal pressure of the pressure chamber 73. Therefore, the pressure adjustment mechanism 70 is classified as a differential pressure valve (in particular, a decompression valve even in differential pressure valves).

An open valve mechanism 81 that supplies the liquid to the liquid ejecting portion 33 by forcefully opening the linking hole 72 may be applied to the pressure adjustment mechanism 70. For example, the open valve mechanism 81 is provided with a pressurized bag 83 that is accommodated in the accommodating chamber 82 that is partitioned into the pressure chamber 73 by the flexible film 77, and a pressurized flow path 84 along which air inside the pressurized bag 83 is caused to flow. Then, the pressurized bag 83 swells due to air that flows through the pressurized flow path 84, and the linking hole 72 is forcefully opened by flexibly displacing the flexible film 77 in a direction in which the capacity of the pressure chamber 73 is reduced. It is possible to perform pressure cleaning in which the liquid that is pressurized from the liquid ejecting portion 33 is caused to flow out by forcefully opening the linking hole 72 using the open valve mechanism 81.

In this case, the pressurized flow path 84 may be connected to the decompression flow path 49 and configured to be able to drive both pressure and decompression of the pump 86. Then, a one-way valve 85 may be provided on the decompression flow path 49, air may flow out to the pressurized bag 83 by pressurization and driving by the pump 86, and the decompression chamber 48 may be decompressed by decompression and driving by the pump 86.

The liquid ejecting portion 33 is provided with a liquid chamber 91 that is linked to the nozzle 36, an accommodating portion 93 that is partitioned into the liquid chamber 91 and a vibration plate 92, an actuator 94 that is accommodated in the accommodating portion 93, and a common liquid chamber 95 that temporarily retains the liquid that is caused to flow out from the pressure chamber 73 and supplies the liquid to a plurality of liquid chambers 91. A filter 96 that filters liquid may be disposed between the pressure chamber 73 and the common liquid chamber 95.

For example, the actuator 94 is a piezoelectric element that contracts in a case where the driving voltage is applied. After the vibration plate 92 changes shape accompanying contraction of the actuator 94, when application of the driving voltage is released, the liquid within the liquid chamber 91 with a changed capacity is ejected as liquid droplets from the nozzle 36.

At this time, when air bubbles are mixed in the nozzle 36, liquid droplets are not appropriately ejected and ejection is inadequate. In addition, in a case where foreign matter such as solid matter is clogged in the nozzle 36 or in a case where viscosity of the liquid is raised by drying and the like, ejection is inadequate. In order to prevent such inadequate ejection, it is preferable to provide the filter unit 41 or the filters 76 and 96 on the supply flow path 37, and remove foreign matter such as air bubbles.

For example, a return flow path 97 along which the liquid returns to the supply flow path 37 between the filter unit 41 and the opening/closing valve 39 may be connected to the common liquid chamber 95, and a circulation pump 98 that causes the liquid to flow from the common liquid chamber 95 toward the return flow path 97 may be disposed on the return flow path 97. According to this configuration, it is possible to capture foreign matter such as air bubbles using the filter unit 41 and the filters 76 and 96 that are on the supply flow path 37 by causing the liquid to circulate between the return flow path 97 and the supply flow path 37 due to driving of the circulation pump 98. In addition, in a case where the liquid includes a sediment component such as pigment, it is possible to uniformize the concentration by agitating the liquid by circulating the liquid and allowing the liquid to pass through the static mixer 42.

Next, the configuration of the pressure feeding mechanism 38 will be exemplified.

For example, the pressure feeding mechanism 38 is a diaphragm pump, and is provided with a pump chamber 61 that is provided on the branched flow path 37*a* that constitutes the supply flow path 37, a displaced member 62 that is constituted by a part of the wall surface of the pump chamber 61, a spring 63 that is disposed outside the pump chamber 61, and a displacement mechanism 64. The displaced member 62 is displaced in a direction in which the capacity of the pump chamber 61 increases and reduces. The spring 63 biases the displaced member 62 in a direction in which the capacity of the pump chamber 61 is reduced. However, preferably a linking groove 61*a* is provided on a part of the wall surface of the pump chamber 61 such that the liquid flows even in a state in which the capacity of the pump chamber 61 becomes minimally small due to the biasing force of the spring 63.

For example, the displacement mechanism 64 has an air chamber 65 that is partitioned into the pump chamber 61 and the displaced member 62 and a suction pump 67 that suctions the air chamber 65 through a ventilation path 66, and displaces the displaced member 62 in a direction in which the capacity of the pump chamber 61 is increased against the biasing force of the spring 63 due to driving of the suction pump 67. Note that, when the suction pump 67 stops driving, there may be a configuration such that air flows into the air chamber 65 through the ventilation path 66 and displaces the displaced member 62 in a direction in which the capacity of the pump chamber 61 is reduced due to the biasing force of the spring 63.

In addition, the pressure feeding mechanism 38 is provided with a suction valve 68 that is provided between the accommodating body holding portion 16 and the pump chamber 61 and a discharge valve 69 that is provided between the pump chamber 61 and the liquid ejecting portion 33. The suction valve 68 is a one-way valve that regulates flow of the liquid that flows out from the pump chamber 61 while permitting the flow of the liquid that flows into the pump chamber 61. The discharge valve 69 is a one-way valve that regulates the flow of the liquid that flows into the pump chamber 61 while permitting the flow of the liquid that flows out from the pump chamber 61. Then, suction driving is performed in which the liquid flows into the pump chamber 61 due to driving by the suction pump 67 and discharge driving is performed in which the liquid flows out from the pump chamber 61 due to the biasing force of the spring 63 by stopping driving by the suction pump 67.

Next, the actions of the liquid ejecting apparatus 11 will be described along with the contents of control that is performed by the control portion 100.

When the remaining amount of the liquid is large immediately after the liquid accommodating body 20 is replaced with a new liquid accommodating body and the like, the control portion 100 does not drive the pressure feeding mechanism 38 and supplies the liquid using the water head with respect to the nozzle 36 of the liquid that is accommodated in the liquid accommodating body 20.

When the linking groove 61*a* is provided in the pump chamber 61 of the pressure feeding mechanism 38 and the branched flow path 37*a* on which the pressure feeding mechanism 38 is disposed and the branched flow path 37*b* of another route are provided, it is possible to maintain a linked state of the supply flow path 37 between the liquid accommodating body 20 and liquid ejecting portion 33 even in the state in which the capacity of the pump chamber 61 becomes minimally small and it is possible to supply the liquid using the water head.

In a case where the liquid is accommodated in the liquid accommodating portion 21, preferably the control portion 100 drives the pressure feeding mechanism 38 to switch supply of the liquid using the pressure feeding mechanism 38 since the liquid tends not to flow out due to reaction force of the liquid accommodating portion 21 that is a bag when the remaining amount of the liquid becomes small. According to this configuration, it is possible to suction the liquid within the liquid accommodating portion 21 and supply pressure to the liquid ejecting portion 33 by driving the pressure feeding mechanism 38.

In this case, when the sensor that detects the remaining amount in the liquid accommodating body 20 is provided and the amount of consumption of the liquid is calculated by the control portion 100, it is possible to further accurately set the timing at which the control portion 100 performs switching. A method for detecting the remaining amount in the liquid accommodating body 20 may be set so as to detect the pressure variation of the supply flow path 37, and may be set such that a retention chamber that retains the liquid is provided on the supply flow path 37 and the liquid surface position of the retention chamber is detected.

In addition, the control portion 100 may switch to supply of the liquid using the pressure feeding mechanism 38 in a case where the amount of flow of the liquid that is discharged from the liquid ejecting portion 33 is larger than a predetermined threshold. For example, when suction cleaning or pressure cleaning is performed, a greater amount of the liquid is discharged from the nozzle 36 than when the liquid for the recording process is ejected. Therefore, when cleaning of the liquid ejecting portion 33 is performed, preferably the control portion 100 drives the pressure feeding mechanism 38.

Alternatively, when the amount of ejection of the liquid per unit of time is smaller than a predetermined threshold, the liquid may be supplied using only the water head and when the amount of ejection of the liquid per unit of time is the predetermined threshold or more, the pressure feeding mechanism 38 may be driven. By doing this, it is possible to supply the liquid due to pressure force of the pressure feeding mechanism 38 even when the amount of flow of the liquid in the supply flow path 37 becomes large and pressure loss becomes large. Otherwise, in a case where for example, ambient temperature is low, preferably liquid supply is performed by the pressure feeding mechanism 38 since viscosity of the liquid rises and the liquid tends not to flow.

According to the embodiment, it is possible to obtain the effects as above.

(1) It is possible to extend the life of the pressure feeding mechanism 38 since the pressure feeding mechanism 38 may not drive in a case where the liquid is supplied by the water head that is generated by a difference in height between the water head center and the nozzle 36.

(2) When the liquid is to be supplied only by the water head, the labor that is taken to attach and detach the liquid accommodating body 20 becomes larger since it is necessary to dispose the accommodating body holding portion 16 for increasing the water head at a high position. In that point, usability is good since it is possible to limit the height of the accommodating body holding portion 16 to the extent that the attachment and detachment operation is not difficult (for example, a reachable height is to the extent of 1.5 m even if the user does not ride on a step or the like) by combining liquid supply by the water head and liquid supply by the pressure feeding mechanism 38.

(3) In the supply of liquid by the water head, it is possible to stabilize an ejection operation of the liquid since pressure variation is lower than a diaphragm pump that alternately performs suction driving and discharge driving.

The embodiment described above may be modified as in the modification examples indicated below. In addition, the configuration that is included in the embodiments described above and the configurations that are included in the modification examples below may be arbitrarily combined and the configurations that are included in the modification examples below may be arbitrarily combined with each other.

The suction valve 68 of the pressure feeding mechanism 38 may regulate the flow of the liquid that flows out from the pump chamber 61 to the extent that suction driving is possible, and may completely block the flow of the liquid that flows out from the pump chamber 61. In the same manner, the discharge valve 69 of the pressure feeding mechanism 38 may regulate the flow of the liquid that flows into the pump chamber 61 to the extent that discharge driving is possible, and may completely block the flow of the liquid that flows into the pump chamber 61.

The one-way valve 40 may not be provided on the branched flow path 37*b* in a case where the branched flow path 37*a* in which the pressure feeding mechanism 38 is disposed and the branched flow path 37*b* of another route are provided.

In a case where the branched flow path 37*a* in which the pressure feeding mechanism 38 is disposed and the branched flow path 37*b* of another route are provided, a switching valve is disposed in a branched portion of the branched flow path 37*a* and the branched flow path 37*b*, and a supply state of the liquid by the water head in a state in which the upstream side connected to the accommodating body holding portion 16 of the supply flow path 37 and the branched flow path 37*b* are linked and a supply state of the liquid by the pressure feeding mechanism that drives the pressure feeding mechanism 38 in a state in which the upstream side connected to the accommodating body holding portion 16 of the supply flow path 37 and the branched flow path 37*a* are linked may be switched between by the control portion 100 controlling the switching valve. Furthermore, the supply state of the liquid by the water head in a state in which the upstream side connected to the accommodating body holding portion 16 of the supply flow path 37 and the branched flow path 37*a* and the branched flow path 37*b* are linked and the supply state of the liquid that drives the pressure feeding mechanism 38 in a state in which the upstream side connected to the accommodating body holding portion 16 of the supply flow path 37 and the branched flow path 37*a* and the branched flow path 37*b* are linked may be provided by the control portion controlling the switching valve.

When the remaining amount of the liquid is large immediately after the liquid accommodating body 20 is replaced with a new liquid accommodating body and the like, supply of the liquid may be performed by the water head with respect to the nozzle 36 of the liquid that is accommodated in the liquid accommodating body 20 in a state in which the accommodating body holding portion 16 that is indicated by a solid line in FIG. 3 is at the attachment and detachment position, and in a case where the amount of flow of the liquid that is discharged from the liquid ejecting portion 33 is larger than the predetermined threshold, the pressure feeding mechanism 38 may be driven by the accommodating body holding portion 16 in a state in which the accommodating body holding portion 16 is at the attachment and detachment position. Then, the pressure feeding mechanism 38 may be driven in a state in which the accommodating body holding portion 16 is at the supply position in a case where suction cleaning or pressure cleaning are performed. When doing so, in addition to the effect of it being possible to stably supply the liquid of a necessary amount in cleaning by driving the pressure feeding mechanism when performing cleaning, it is possible to perform supply of the liquid in a state in which the liquid that includes many sediment components within the liquid accommodating body 20 tends not to flow out at the attachment and detachment position when the recording process is performed, perform supply of the liquid in a state in which the liquid that includes many sediment components within the liquid accommodating body 20 tends to flow out at the supply position when cleaning is performed, and perform cleaning in which foreign matter such as sediment component within the liquid accommodating body 20 or air bubbles inside the liquid ejecting portion, and the like is eliminated.

The liquid within the liquid accommodating body 20 may be agitated by rotating the accommodating body holding portion 16. In addition, the accommodating body holding portion 16 may move to the attachment and detachment position in a stopped state in which the recording process or the cleaning are not performed or a power source off state in which the power source of liquid ejecting apparatus 11 is not turned on.

It is possible that the flow amount of the liquid that is discharged from the liquid ejecting portion 33 is calculated by the control portion 100 from the ejection amount of the liquid per unit of time from the liquid ejecting portion 33 or the discharge amount of the liquid when cleaning, and in addition to detecting and calculating the change of a remaining amount of the liquid accommodating body 20 in the predetermined time using a sensor, it is possible to detect by disposing a flow amount sensor on the supply flow path 37.

Figure 6:
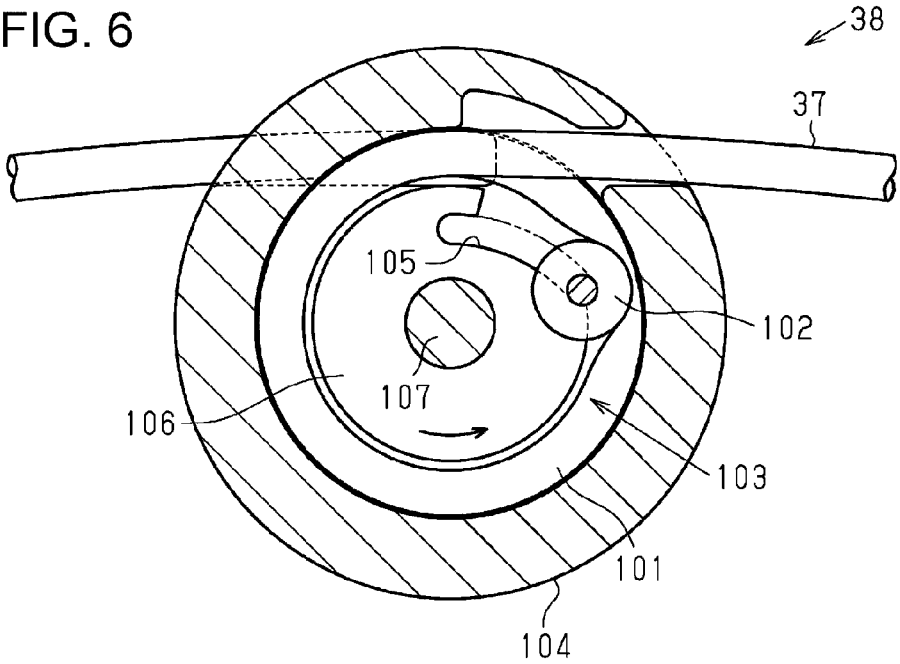
FIG. 6 is a sectional view illustrating a modification example of a pressure feeding mechanism.

As in the manner of the modification example indicated in FIG. 6, the pressure feeding mechanism 38 may be a tube pump that has a tube 101 that can be flexibly displaced which constitutes the supply flow path 37, a pressing member 102 that squashes the tube 101, and a movement mechanism 103 that moves the pressing member 102, and performs feeding of the liquid by moving the pressing member 102 that squashes the tube 101 using the movement mechanism 103. The movement mechanism 103 is provided with, for example, a cylindrical shape housing 104 that accommodates the tube 101, a rotating body 106, which has a guide groove 105 that locks the pressing member 102, and that is accommodated within the housing 104, and a revolving shaft 107 that rotates due to the driving force of a driving source which is not shown in the drawings. Then, the pressing member 102 is moved by rotating the rotating body 106 along with the revolving shaft 107. Note that, the right side in FIG. 6 is an upstream side of the supply flow path 37 and the left side in FIG. 6 is a downstream side of the supply flow path 37.

The guide groove 105 may be set so that the distance from the center of rotation is changed, the tube 101 is squashed when the pressing member 102 is locked to a first end distant from the center of rotation of the guide groove 105, and when the pressing member 102 comes close to the second end close to the center of rotation of the guide groove 105, squashing of the tube 101 is released. In this case, when the rotating body 106 rotates in a first direction that is indicated by an arrow in FIG. 6, the liquid within the tube 101 is subjected to pressure feeding since the pressing member 102 that is locked to the first end of the guide groove 105 moves while squashing the tube 101. In addition, when the rotating body 106 rotates in a second direction that is an opposite direction from the first direction, the liquid is not subject to pressure feeding since the pressing member 102 moves in the second end of the guide groove 105 and the squashing of the tube 101 is released.

In this case, the control portion 100 may control the movement mechanism 103 and release squashing of the tube 101 by the pressing member 102 when supply of the liquid by the pressure feeding mechanism 38 that is a tube pump is switched to supply of the liquid by the water head. According to this configuration, even in a case where pressure feeding of the liquid by the tube pump is not performed, it is possible to maintain the linked state of the supply flow path 37 between the liquid accommodating body 20 and the liquid ejecting portion 33 and it is possible to supply the liquid using the water head.

Figure 7:
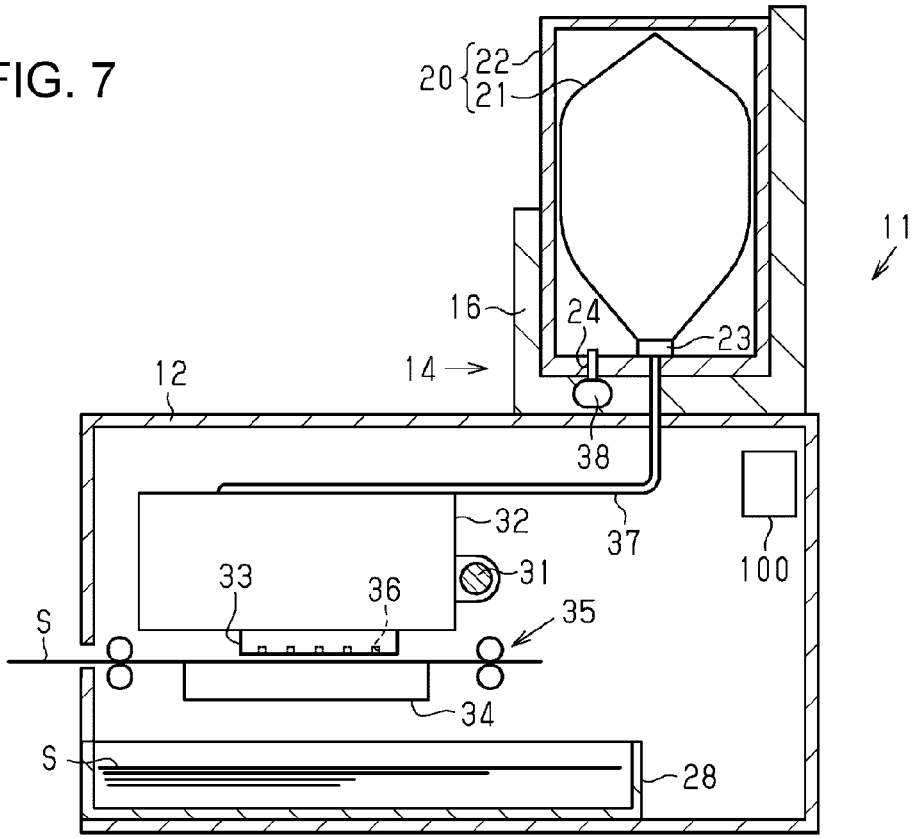
FIG. 7 is a sectional view illustrating a modification example of a liquid ejecting apparatus.

As in the manner of the modification example indicated in FIG. 7, the pressure feeding mechanism 38 may pressurize the liquid within the liquid accommodating body 20 and cause the liquid to flow out on the supply flow path 37 by pressurized air flowing out through the air supply path 24 in the liquid accommodating body 20 (for example, a space between the case 22 and the liquid accommodating portion 21) that is mounted in the accommodating body holding portion 16.

As in the manner of the modification example indicated in FIG. 7, for example, the pressure feeding mechanism 38 is included in the liquid supply device 14, and it is also possible to dispose the pressure feeding mechanism 38 outside the casing 12.

The position of the accommodating body holding portion 16 may be disposed above the carriage 32, for example, within the casing 12 and not on the casing 12.

As in the manner of the modification example indicated in FIG. 7, there may be a configuration in which the accommodating body holding portion 16 does not move. Even in this case, it is possible to supply liquid using the water head during liquid ejection if a value of pressure equivalent to the water head with respect to the nozzle 36 of the liquid that is accommodated in the liquid accommodating body 20 that is mounted in the accommodating body holding portion 16 is larger than pressure loss that is generated when the liquid is ejected for a recording process.

As in the manner of the modification example indicated in FIG. 7, attachment and detachment may be performed with respect to the accommodating body holding portion 16 by non-horizontal movement (for example, vertical movement) of the liquid accommodating body 20.

As in the manner of the modification example indicated in FIG. 7, the liquid ejecting apparatus 11 may not be provided with the support leg portion 13. In addition, instead of the feeding mechanism 25, the winding mechanism 26, and the tension bar 27, the liquid ejecting apparatus 11 may mount, to be attachable and detachable, the cassette 28 that accommodates the medium S which is a single slip of paper that is cut to a predetermined size.

The liquid that is ejected by the liquid ejecting portion 33 is not limited to ink, and for example, particles of the functional material may be a liquid body and the like that is dispersed or mixed in the liquid. For example, there may be a configuration in which recording is performed by ejecting a liquid form body including, in a dispersed or dissolved form, material such as an electrode material or color material (pixel material) which are used in manufacture and the like of a liquid crystal display, an electro-luminescence (EL) display, and a surface light emission display.

The medium S is not limited to a paper sheet, and may be a plastic film, thin plate material, and the like, and may be a fabric which is used in a printing apparatus and the like. In addition, the medium S may be clothing and the like of an arbitrary shape such as a T-shirt, and may be a three-dimensional object with an arbitrary shape such as tableware or stationery.

Hereinafter, technical concepts and the actions and effects thereof that are ascertained from the embodiments and the modification examples described above will be described.

Concept 1

A liquid ejecting apparatus comprising: a liquid ejecting portion that has a nozzle and performs a recording process by ejecting liquid toward a medium from the nozzle; a supply flow path that is provided to be able to cause the liquid that is accommodated in the liquid accommodating body to flow toward the liquid ejecting portion; a pressure feeding mechanism that forcefully causes the liquid to flow from the liquid accommodating body toward the liquid ejecting portion; an accommodating body holding portion that is capable of having the liquid accommodating body mounted thereon and is disposed at a supply position at which it is possible to supply the liquid to the liquid ejecting portion using a water head with respect to the nozzle of the liquid that is accommodated in the mounted liquid accommodating body; and a control portion that switches between supply of the liquid by the water head and supply of the liquid by the pressure feeding mechanism.

According to Concept 1, it is possible to shorten driving time of the pressure feeding mechanism further than in a case where the liquid is supplied by only the pressure feeding mechanism since the pressure feeding mechanism need not be driven while performing supply of the liquid by the water head.

Concept 2

The liquid ejecting apparatus according to Concept 1, in which a pressure which the pressure feeding mechanism is capable of applying to the liquid is larger than the value of pressure equivalent to the water head at the supply position.

According to Concept 2, it is possible to compensate for the amount of supply of the liquid due to pressure of the pressure feeding mechanism in a case where supply of the liquid by the water head is insufficient since pressure that it is possible for the pressure feeding mechanism to apply to the liquid is larger than supply pressure by the water head. In addition, it is possible to limit the height of the accommodating body holding portion and for it to be easy to carry out mounting work of the liquid accommodating body since it is not necessary for the water head to be excessively large by compensating the supply of the liquid using the pressure feeding mechanism.

Concept 3

The liquid ejecting apparatus according to Concept 1 of Concept 2, in which the control portion drives the pressure feeding mechanism in a case where the amount of flow of the liquid that is discharged from the liquid ejecting portion is larger than a threshold.

According to Concept 3, it is possible to supply the liquid of a necessary amount by driving the pressure feeding mechanism in a case where the amount of flow of the liquid that is discharged from the liquid ejecting portion is great. In addition, when the amount of flow of the liquid that is discharged from the liquid ejecting portion is low, it is possible to shorten driving time of the pressure feeding mechanism since liquid supply is performed by the water head.

Concept 4

The liquid ejecting apparatus according to any one of Concept 1 to Concept 3, in which the control portion drives the pressure feeding mechanism when performing cleaning of the liquid ejecting portion by discharging from the nozzle an amount of the liquid that is greater than an amount of the liquid when the liquid is ejected for a recording process.

According to Concept 4, it is possible to perform cleaning in which foreign matter such as air bubbles inside the liquid ejecting portion and the like is discharged by discharging from the nozzle an amount of the liquid that is greater than an amount of the liquid when the liquid is ejected. In addition, it is possible to stably supply the liquid of an amount that is necessary in cleaning by driving the pressure feeding mechanism during cleaning.

Concept 5

The liquid ejecting apparatus according to any one of Concept 1 to Concept 4, in which a value of pressure equivalent to the water head at the supply position is larger than pressure loss that is generated when the liquid is ejected for the recording process.

According to Concept 5, it is possible to supply the liquid that is used in the recording process using the water head since the value of pressure equivalent to the water head is larger than pressure loss during the recording process by mounting the liquid accommodating body in the accommodating body holding portion at the supply position. Then, in the supply of liquid by the water head, it is possible to stabilize the ejection operation of the liquid since pressure variation is low.

Concept 6

The liquid ejecting apparatus according to any one of Concept 1 to Concept 5, in which the pressure feeding mechanism includes: a pump chamber that is provided on the supply flow path; a displaced member that constitutes a part of a wall surface of the pump chamber and is displaced in a direction in which the capacity of the pump chamber increases and reduces; a spring that is disposed outside the pump chamber and biases the displaced member in a direction in which the capacity of the pump chamber is reduced; a displacement mechanism that displaces the displaced member in a direction in which the capacity of the pump chamber is increased against the biasing force of the spring; a suction valve that is provided between the accommodating body holding portion and the pump chamber and regulates flow of the liquid that flows out from the pump chamber while permitting flow of the liquid that flows into the pump chamber; and a discharge valve that is provided between the pump chamber and the liquid ejecting portion and regulates flow of the liquid that flows into the pump chamber while permitting flow of the liquid that flows out from the pump chamber.

According to Concept 6, it is possible to reduce a load that is applied to the pressure feeding mechanism by combining liquid supply by the water head since the load that is applied to the displaced member is larger the longer the time in which the pressure feeding mechanism drives.

Concept 7

The liquid ejecting apparatus according to any one of Concept 1 to Concept 5, in which the pressure feeding mechanism is a tube pump that has a tube that can be flexibly displaced and constitutes the supply flow path, a pressing member that squashes the tube, and a movement mechanism that moves the pressing member, and pressure feeds the liquid by moving the pressing member that squashes the tube using the movement mechanism, and the control portion controls the movement mechanism and releases squashing of the tube by the pressing member when supply of the liquid by the pressure feeding mechanism is switched to supply of the liquid by the water head.

According to Concept 7, it is possible to reduce a load that is applied to the pressure feeding mechanism by combining liquid supply by the water head since the load that is applied to the tube and the like is larger the longer the time in which the pressure feeding mechanism drives. In addition, when the supply of the liquid by the pressure feeding mechanism is switched to the supply of the liquid by the water head, even in a case where pressure feeding of the liquid by the tube pump is not performed by releasing the squashing of the tube using the pressing member, it is possible to maintain the linked state of the supply flow path between the liquid accommodating body and the liquid ejecting portion and it is possible to supply the liquid using the water head.

Concept 8

The liquid ejecting apparatus according to any one of Concept 1 to Concept 5, in which the pressure feeding mechanism increases the pressure of the liquid within the liquid accommodating body and causes the liquid to flow out on the supply flow path by flowing out of pressurized air in the liquid accommodating body that is mounted in the accommodating body holding portion that is attachable and detachable.

According to Concept 8, it is possible to suppress deterioration of the pressure feeding mechanism accompanying driving by pressurizing the liquid by pressurized air in the liquid accommodating body that is replaceable by attachment and detachment flowing out.

Concept 9

The liquid ejecting apparatus according to any one of Concept 1 to Concept 5, in which the accommodating body holding portion is provided to be movable between the supply position and the attachment and detachment position at which the position of the mounted liquid accommodating body is lower than the supply position, and the liquid accommodating body is attached to and detached from the accommodating body holding portion at the attachment and detachment position.

According to Concept 9, it is possible to easily perform the attachment and detachment operation of the liquid accommodating body since the attachment and detachment position of the accommodating body holding portion is lower than the supply position. In addition, it is possible to increase the size of the water head with respect to the nozzle of the liquid that is accommodated in the liquid accommodating body since the supply position is higher than the attachment and detachment position.

The entire disclosure of Japanese Patent Application No. 2016-158437, filed Aug. 12, 2016 is expressly incorporated by reference herein.

What is claimed is:

1. A liquid ejecting apparatus comprising:

a liquid ejecting portion that has a nozzle and performs a recording process by ejecting liquid from the nozzle toward a medium;

a supply flow path that is provided so as to allow the liquid that is accommodated in a liquid accommodating body to flow toward the liquid ejecting portion;

a pressure feeding mechanism that forcefully causes the liquid to flow from the liquid accommodating body toward the liquid ejecting portion; and an accommodating body holding portion that is capable of holding the liquid accommodating body mounted thereon and is disposed at a supply position at which it is possible to supply the liquid to the liquid ejecting portion using a water head with respect to the nozzle of the liquid that is accommodated in the mounted liquid accommodating body, wherein the accommodating body holding portion is provided to be movable between the supply position and an attachment and detachment position at which the position of the mounted liquid accommodating body is lower than the position of the liquid accommodating body at the supply position.

2. The liquid ejecting apparatus according to claim 1, wherein a pressure which the pressure feeding mechanism is capable of applying to the liquid is larger than the value of pressure equivalent to the water head at the supply position.

3. The liquid ejecting apparatus according to claim 1, further comprising:

a control portion that controls a supply state of the liquid to the liquid ejecting portion, wherein the control portion drives the pressure feeding mechanism in a case where the amount of flow of the liquid that is discharged from the liquid ejecting portion is larger than a threshold.

4. The liquid ejecting apparatus according to claim 1, further comprising:

a control portion that controls a supply state of the liquid to the liquid ejecting portion, wherein the control portion drives the pressure feeding mechanism when performing cleaning of the liquid ejecting portion by discharging from the nozzle an amount of the liquid that is greater than an amount of the liquid when the liquid is ejected for a recording process.

5. The liquid ejecting apparatus according to claim 1, wherein a value of pressure equivalent to the water head at the supply position is larger than a pressure loss that is generated when the liquid is ejected for a recording process.

6. The liquid ejecting apparatus according to claim 1, wherein the pressure feeding mechanism includes:

a pump chamber that is provided on the supply flow path;

a displaced member that constitutes a part of a wall surface of the pump chamber and is displaced in a direction in which the capacity of the pump chamber increases and reduces;

a spring that is disposed outside the pump chamber and biases the displaced member in a direction in which the capacity of the pump chamber is reduced;

a displacement mechanism that displaces the displaced member in a direction in which the capacity of the pump chamber is increased against the biasing force of the spring;

a suction valve that is provided between the accommodating body holding portion and the pump chamber and regulates flow of the liquid that flows out from the pump chamber while permitting flow of the liquid that flows into the pump chamber; and a discharge valve that is provided between the pump chamber and the liquid ejecting portion and regulates flow of the liquid that flows into the pump chamber while permitting flow of the liquid that flows out from the pump chamber.

7. The liquid ejecting apparatus according to claim 1, further comprising:

a control portion that controls a supply state of the liquid to the liquid ejecting portion, wherein the pressure feeding mechanism is a tube pump that has a tube that can be flexibly displaced and constitutes the supply flow path, a pressing member that squashes the tube, and a movement mechanism that moves the pressing member, and pressure feeds the liquid by moving the pressing member that squashes the tube using the movement mechanism, and the control portion controls the movement mechanism and releases squashing of the tube by the pressing member when supply of the liquid by the pressure feeding mechanism is switched to supply of the liquid by the water head.

8. The liquid ejecting apparatus according to claim 1, wherein the pressure feeding mechanism increases the pressure of the liquid within the liquid accommodating body and causes the liquid to flow out on the supply flow path by flowing out of pressurized air in the liquid accommodating body that is mounted in the accommodating body holding portion that is attachable and detachable.

9. The liquid ejecting apparatus according to claim 1, wherein the liquid accommodating body is attached to and detached from the accommodating body holding portion at the attachment and detachment position.

10. The liquid ejecting apparatus according to claim 1, wherein the supply flow path includes a first portion that connects the liquid accommodating body holding portion and the pressure feeding mechanism and a second portion that branches off of the first portion and connects the liquid accommodating body holding portion and the liquid ejecting portion.

11. The liquid ejecting apparatus according to claim 1, wherein the second portion includes a one-way valve that suppresses flow of the liquid toward the liquid accommodating body holding portion while permitting flow of the liquid toward the liquid ejecting portion.

12. A liquid supply method of a liquid ejecting apparatus, the liquid ejecting apparatus including:

a liquid ejecting portion that has a nozzle and performs a recording process by ejecting liquid from the nozzle toward a medium;

a supply flow path that is provided so as to allow the liquid that is accommodated in a liquid accommodating body to flow toward the liquid ejecting portion;

a pressure feeding mechanism that forcefully causes the liquid to flow from the liquid accommodating body toward the liquid ejecting portion; and an accommodating body holding portion that is capable of holding the liquid accommodating body mounted thereon and is disposed at a supply position at which it is possible to supply the liquid toward the liquid ejecting portion using a water head with respect to the nozzle of the liquid that is accommodated in the mounted liquid accommodating body, the accommodating body holding portion is provided to be movable between the supply position and an attachment and detachment position at which the position of the mounted liquid accommodating body is lower than the position of the liquid accommodating body at the supply position, the method comprising:

driving the pressure feeding mechanism in a case where the amount of flow of the liquid that is discharged from the liquid ejecting portion is larger than a threshold.

13. The liquid supply method of a liquid ejecting apparatus according to claim 12, the method further comprising:

attaching the liquid accommodating body to and detaching from the accommodating body holding portion at the attachment and detachment position.

* * * * *